US006485343B1

(12) United States Patent
Børseth

(10) Patent No.: US 6,485,343 B1
(45) Date of Patent: Nov. 26, 2002

(54) DYNAMIC POSITIONING DOCK-LOADING BUOY (DPDL-BUOY) AND METHOD FOR USE OF SUCH A DPDL-BUOY

(75) Inventor: Knut Børseth, Tårnåsen (NO)

(73) Assignee: PGS Offshore Technology AS, Lysaker (NO)

( * ) Notice: Subject to any disclaimer, the term of this patent is extended or adjusted under 35 U.S.C. 154(b) by 0 days.

(21) Appl. No.: 09/606,489

(22) Filed: Jun. 29, 2000

(30) Foreign Application Priority Data

Jun. 29, 1999 (NO) ..... 993251

(51) Int. Cl.[7] ..... B63B 22/02; B63B 35/44
(52) U.S. Cl. ..... 441/4; 114/258
(58) Field of Search ..... 441/3, 4; 114/49, 114/256, 258, 263, 264, 265, 266; 166/352, 353, 354, 355

(56) References Cited

U.S. PATENT DOCUMENTS 3,490,406 A * 1/1970 O'Reilly et al. ..... 114/265
3,707,934 A 1/1973 Frankel
3,741,264 A * 6/1973 Kinoshita ..... 141/383
3,975,841 A 8/1976 Steenken et al.
H001315 H * 6/1994 Levine ..... 114/61.12
5,803,779 A 9/1998 Horton, III

FOREIGN PATENT DOCUMENTS

DE 2420026 C2 3/1983

* cited by examiner

*Primary Examiner*—S. Joseph Morano
*Assistant Examiner*—Andy Wright

(57) ABSTRACT

A loading device for marine transfer of fluids, via a flexible loading hose, from a petroleum production platform to an ordinary tanker vessel has a main hull which includes a submerged hull and a structure resting on the submerged hull an rising above the waterline. A loading hose is arranged in a crane boom and is connected upstream to the flexible hose and arranged for transferring fluid to the tanker vessel. The loading device further includes fixed contact surfaces having upwards directed surfaces on the submerged hull. The submerged hull is arranged for being ballasted and deballa ted for docking towards the bottom of the tanker vessel's hull, using direct contact friction. A power device is arranged for moving the loading device into and out of a catching position with the tanker vessel, and is arranged for controlling the position of the tanker vessel during the operation of fluid transfer.

13 Claims, 4 Drawing Sheets

DYNAMIC POSITIONING DOCK-LOADING BUOY (DPDL-BUOY) AND METHOD FOR USE OF SUCH A DPDL-BUOY

CROSS REFERENCE TO RELATED APPLICATIONS

This application claims priority to Norvegian patent application Serial No. 1999.3251, filed Jun. 29, 1999.

STATEMENT REGARDING FEDERALLY SPONSORED RESEARCH OR DEVELOPMENT

Not applicable.

BACKGROUND OF THE INVENTION

1. Field of the Invention

This invention relates to a surface loading buoy for transfer of petroleum cargo to an ordinary tanker vessel.

From the source or the upstream side the floating loading buoy receives the petroleum cargo from a petroleum production platform or ship via a flexible loading hose with an electrical (umbilical) cable. The floating loading buoy may possibly receive the petroleum cargo via a submerged loading buoy, e.g., a so-called STL-buoy from the upstream side. The invention comprises a surface loading buoy being arranged for connecting itself to ordinary tanker vessels, and to transfer the cargo directly to, ordinary tanker vessels. From these properties an abbreviation arises, which hereafter will be applied for a preferred embodiment of the invention, a DPDL-buoy: Dynamic Positioning Dock Loading buoy. The loading buoy, according to the preferred embodiment of the invention, is locked to the tanker vessel and takes over the dynamic position control over the vessel. The positioning control is conducted either by means of thrusters and dynamic positioning, or alternatively conducted by using the mooring system of a submerged turret loading buoy (STL-buoy) which normally is moored with a circular-spread anchor line system. Taking the control over the tanker vessel and conducting the position control can take place by a combination where the floating loading buoy, according to a preferred embodiment of the invention, picks up and hooks on to a tanker vessel and conducts a takeover of the physical control of it by means of the buoy's thrusters, and thereafter it transfers the petroleum cargo from the STL-buoy via the DPDL-buoy to the tanker vessel. In an alternative preferred embodiment of the invention, the DPDL-buoy commands an STL-buoy to dock into an STL-dock in the bottom of the DPDL-buoy, and transfers the cargo.

2. Description of the Related Art

A side elevation view of parts of a tanker vessel 200 is shown in FIG. 3, and a simple cross-section of hull 210 and tanks are shown in FIG. 1. Ordinary tanker vessels 200 usually have a pipeline system for loading and offloading petroleum cargo with the vessel being loaded and unloaded via a midship manifold 230 directed out towards the hull's side on the deck 220 of the tanker vessel. Such an arrangement is not normally directly applicable for offloading petroleum cargo from a floating loading buoy in the open sea, without making essential modifications. If the tanker vessel 200 becomes lying in a disadvantageous attitude with respect to the combined wind- and wave direction, it encounters strong side forces and it may show impossible to keep the vessel in position even though it may be provided with dynamic positioning systems ("DP"). Further, a floating loading buoy's anchor lines normally are dimensioned to keep the buoy itself in a fixed position with respect to wind, waves and current, and may be also a tanker vessel if the tanker vessel is lying directed with the bow on the weather. The mooring lines are normally not dimensioned to keep a tanker vessel lying across the weather's direction. Such loading buoys may comprise systems for transfer of cargo via fixed pipes or floating loading hoses running from the loading buoy to the bow 213 of the tanker vessel 200, with mooring lines between the loading buoy's and the tanker vessel's respective starboard and port sides.

Floating production, storage, and offloading vessels (FPSO-vessels) 300 are also known, with cargo transfer of petroleum happening via a floating loading hose arranged between starboard or port side of the FPSO's stem, to the corresponding starboard or port midship manifold 230 with a manifold connector 337 on an ordinary tanker vessel 200. Damage and wear of such floating loading hoses are well known to people skilled in the art.

Submerged Turret Loading (STL)—buoys 331 are well known and are used for transferring cargo from a petroleum source 300 to a tanker vessel 200. The STL-buoy normally is arranged at the end of an STL-umbilical 332 which may comprise a loading hose or a riser pipe. The STL-buoy is adapted to be arranged at a distance below the sea surface to be raised as a plug for insertion into a corresponding STL-dock 233 arranged through the bottom 212' of a specially adapted (modified) STL tanker vessel 200', and with the STL-buoy at the same time being connected to a connector of a manifold coupled to pipelines leading to tanks on board the STL-tanker vessel 200'. STL-buoys usually are moored by means of at least eight anchor lines (340) arranged with anchors around the periphery. By means of the anchor lines 340 the STL-buoy 331 is kept in its position, and the vessel may normally lie freely pivotable in the STL-buoy 33 1. By means of ordinary STL-buoys a wire system on the tanker vessel is normally required for connecting to the STL-buoy, and communication devices for controlling the submergence and rise of the STL-buoy. Further it is required that the tanker vessel is specially designed with the particular STL-dock 333 having a shape of an inverted funnel-shaped vertical pipe channel arranged through the bottom of the vessel, ahead of midship of the tanker vessel 200'. The STL-dock is arranged for receiving and holding the STL-buoy, and is provided with connectors for the petroleum conductor in the STL-buoy, valves, valve control, and a pipe manifold arranged at the receiving part. The pipe manifold is connected to one or more pipelines leading to petroleum tanks in the tanker vessel. One problem in the known art is thus that such an STL-dock must be arranged in all dedicated vessels which are to receive an STL-buoy. This incurs huge costs in installing this equipment on tanker vessels 200' during construction of new vessels 200' or for refitting of ordinary tanker vessels 200.

BRIEF SUMMARY OF THE INVENTION

The invention is constituted by a loading device for marine transfer of fluids via a flexible hose which preferably also has an electrical cable for power supply to the loading device, preferably petroleum fluid from an upstream source, e.g. a petroleum production platform, to an ordinary tanker vessel, and with a main hull comprising an underwater part and a part above the surface with a loading hose in a crane boom, arranged for transferring petroleum cargo from the flexible hose to the tanker vessel via the loading device. What is particular for the invention comprises the following features:

fixed contact surfaces constituted by the top surfaces of a longship pontoon and an athwartships pontoon respectively, arranged for being ballasted and deballasted for docking, by direct friction contact with the tanker vessel's hull, preferably against the outer side of the tanker ship's bottom, and power devices arranged to move the loading device to and from a catching/holding position with the tanker vessel, and arranged for essentially controlling the position of the tanker vessel during the petroleum transfer operation.

DETAILED DESCRIPTION OF THE INVENTION

Advantages of the Invention.

The advantage of the invention is that one may use ordinary tanker vessels to take off the production offshore and that one thereby saves the cost of constructing dedicated offshore tanker vessels. Thereby ordinary tanker vessels which might be available for commission may appear by the loading buoy to receive cargo. The invention is particularly applicable in waters offshore West Africa and Brazil, and in the Gulf of Mexico, where it may be desirable to tanker tonnage which is not among dedicated offshore tanker vessels, but the invention may also be applicable in other sea areas. Additional features by the invention is that one does not need the specially constructed tonnage in the form of production storage tanks at the production platform or a conventional production vessel, but may load the produced petroleum directly over to ordinary tanker vessels. Further, the loading operation will be conducted in a safer way because the entire control over the tanker vessel and the loading buoy is gathered in the operation room or the pilothouse on board the loading buoy, and that the tanker vessel is passively guided by the loading buoy. In this way, some possibilities of misunderstanding between the parties during the load transfer are removed. The risk of collision between the loading buoy and the tanker vessel when load transfer has been initiated is eliminated.

DETAILED DESCRIPTION OF THE PREFERRED EMBODIMENT

Figure 1:
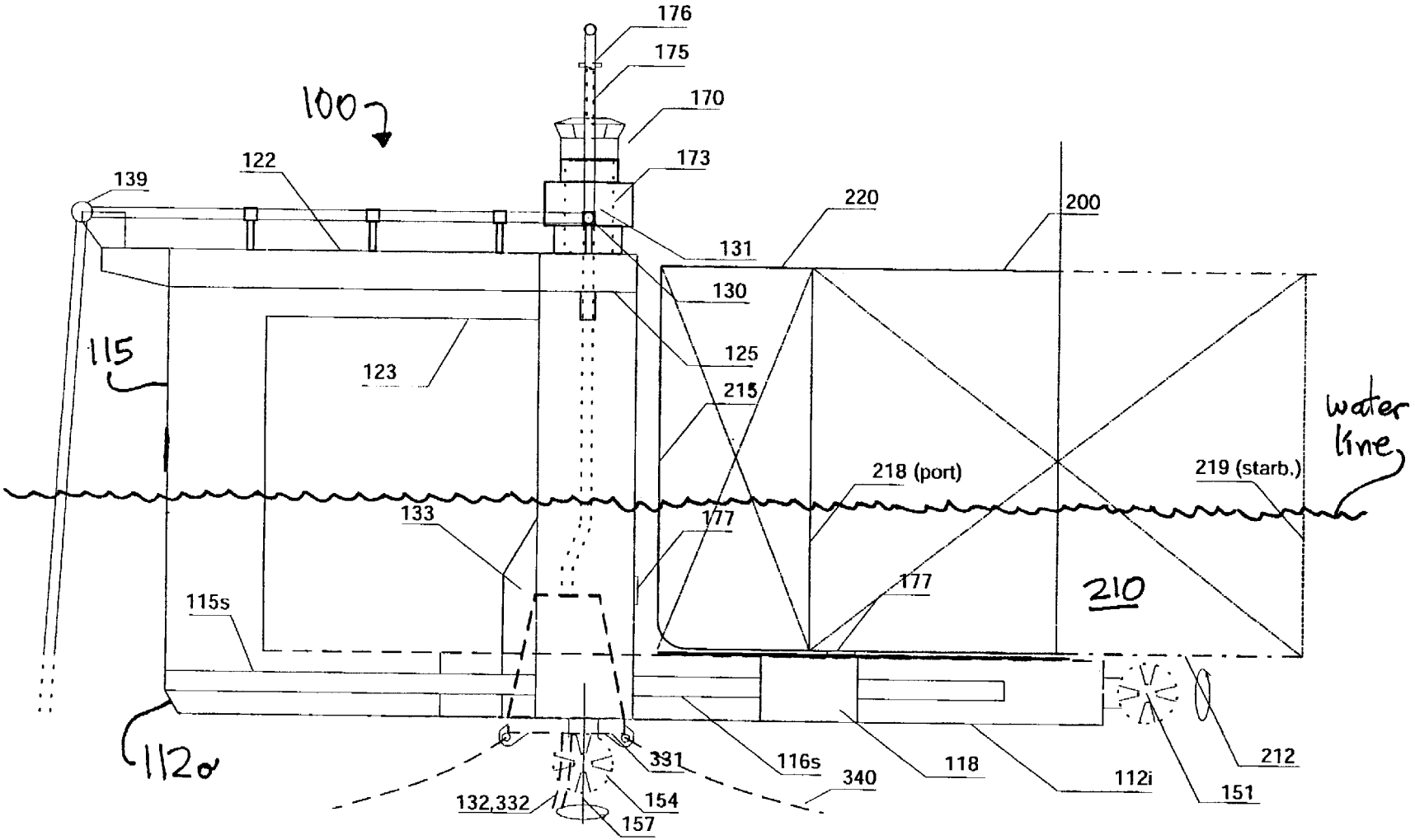
FIG. 1 shows a section from port to starboard of a tanker vessel and an outline and partial section through a loading buoy according to the invention.

With reference to FIG. 1 a preferred embodiment of the invention is illustrated. A loading device 100 for marine transfer of fluids via a flexible hose 132, 332 which preferably also has an electrical cable for power supply to the loading device 100, preferably for petroleum load from an upstream source, e.g. a petroleum production platform 300, to an ordinary tanker vessel 200. Such a flexible hose 132, 332 is often called an "umbilical." The loading device has a main hull 110 comprising an underwater part 111, 112 and a part 121, 123 above the water line, and is under some circumstances a surface vessel. One may see from FIG. 3 that a loading hose 130 is arranged on the deck of the loading device 100, the loading hose being arranged in a crane boom 134 and arranged from transferring petroleum cargo from the flexible hose 132, 332 to the tanker vessel 200 via the loading device 100. This crane boom 134 is arranged for being rotated away from the tanker vessel 200 approaching the loading device 100 during the coupling in order to avoid collision between the crane boom 134 and the tanker vessel 200. The crane boom with corresponding equipment will be further explained later.

The novel and distinguishing features of the preferred embodiment of the invention is the following:

*The loading device 100 has fixed contact surfaces 118', 119 comprised by the top surfaces of a longship pontoon 118 and an athwartships pontoon 119 respectively, both arranged for being ballasted and deballasted for docking, by direct friction contact with the tanker vessel's 200 hull 210, preferably toward the outside 212 of the tanker vessel's bottom.

Figure 2:
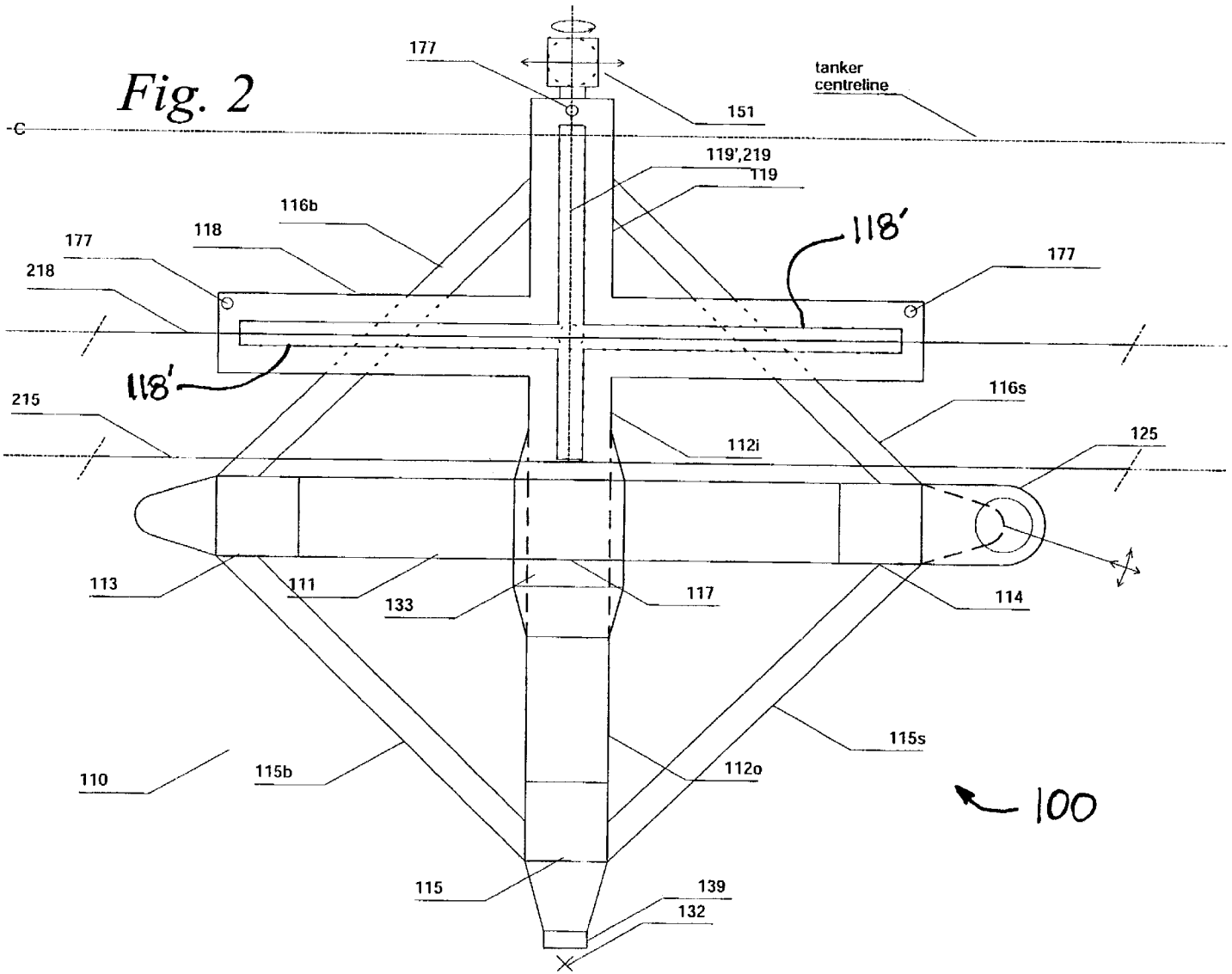
FIG. 2 is a deck plan or an outline of the loading buoy as seen from above.

FIG. 2 shows in deck plan outline of the loading device a very large cross illustrating the contact surfaces 118', 119'. These contact surfaces may in a preferred embodiment comprise rubber or synthetic packer with a high friction coefficient in water, which is able to constitute the contact surface of the top of the longship pontoon 118 and the athwartships pontoon 119 towards the tanker vessel's 200 bottom 212. After contact is established between the contact surfaces 118', 119' and the tanker vessel bottom 212, an estimated 500 tons further deballasting of the loading device 100 is needed to create the needed friction contact holding force against the tanker vessel bottom. If the friction coefficient N is approximately equal to unity one may thereby achieve 500 tons horizontal holding force between the loading device 100 and the tanker vessel 200. The large extension of the cross constituted by the contact surfaces 118' and 119' is important also due to the fact that the contact surfaces shall transfer a rotation moment from thrusters (described below) of the loading device to the tanker vessel 200.

*The loading device 100 is provided with power devices 151, 153, 154 arranged to move the loading device 100 to and from a contact position with the tanker vessel 200. The power devices are also arranged for essentially controlling the tanker vessel's 200 position during the petroleum cargo transfer operation. The energy for the power devices 151, 153, 154 and the ballast pumps is according to the preferred embodiment transferred by means of the flexible hose's 132, 332 above mentioned electrical cable. One of the main purposes of the invention is that with this minimum configuration the loading device 100 is capable of attaching to an ordinary tanker vessel 200 and to gain control over and position the tanker vessel 200 dynamically while the loading device 100 also fills (loads) the ordinary tanker vessel 200 with the liquid cargo which it is supplied with from flexible hose 132 or 332. Several advantageous details of the device are described below.

In the most preferred embodiment of the invention the loading device comprises the following power devices:

An inner longship thruster 151 arranged for exerting force in the loadship direction of the tanker vessel 200, preferably as a replacement for the force from the tanker vessel's main propeller 251. The inner longship thruster 151 is arranged with power action along the tanker vessel's 200 longship direction. The result of this is that the force from the tanker vessel's 200 main propeller 251 may be reduced to a minimum, or entirely halted, so that the tanker vessel's 200 propeller 251 may be disregarded during the dynamic positioning of the loading device 100 when it is coupled to the tanker vessel 200. This makes the DP and cargo transfer operation more certainly achieved, and with improved safety. (A longship directed thruster may also be arranged on the center hull 111 of the loading device 100, but this may entail torsion of the coupled vessels because it would reside outside of the tanker vessel's 200 centerline. Such an outer longship directed thruster would be able to additionally provide a rotation force on the loading device and its coupled tanker vessel, but it would increase the construction, maintenance and running costs and is thus not illustrated in the drawings).

Figure 3:
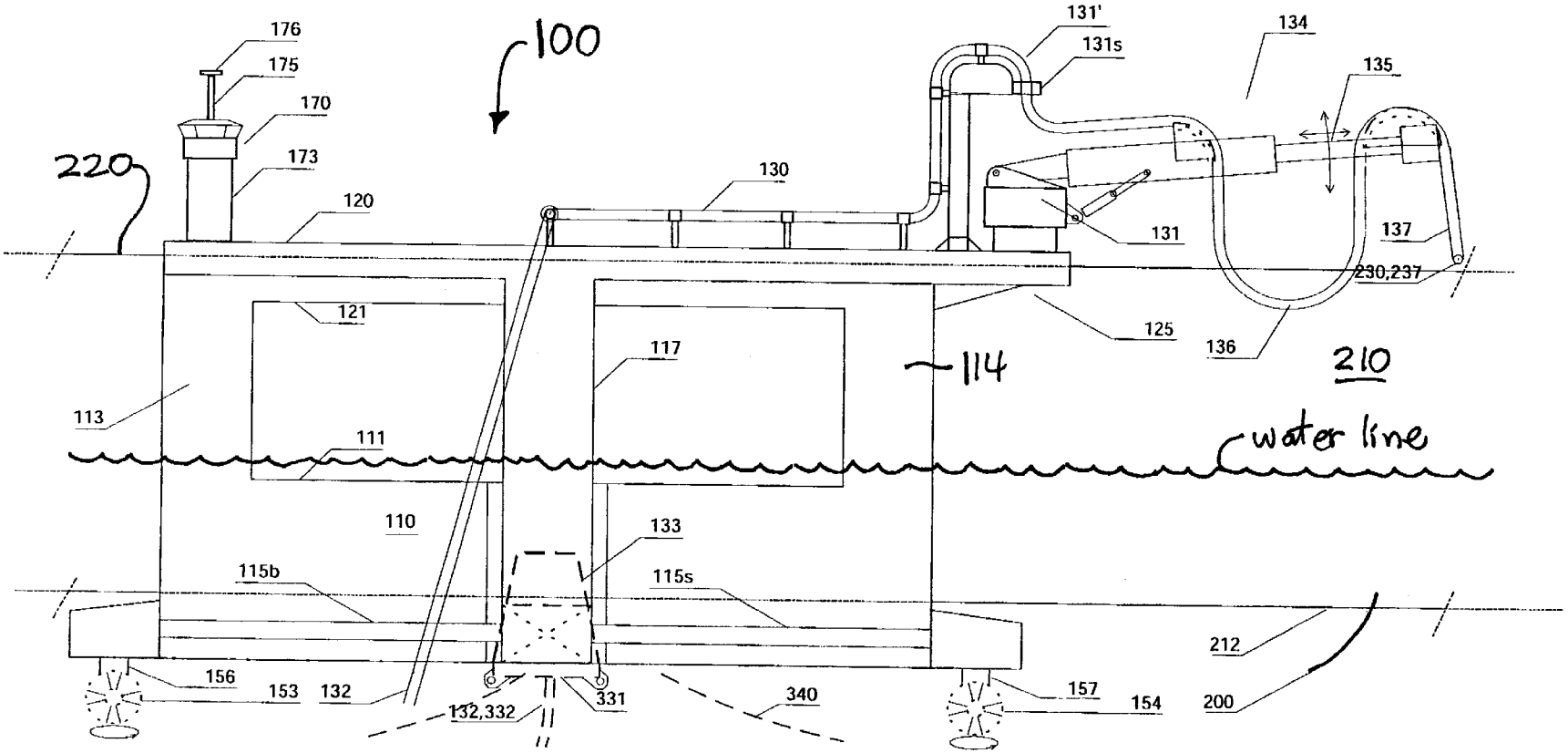
FIG. 3 is a side elevation view from the port side and a partial section of the loading buoy and a side elevation view of a part of a tanker vessel.
Figure 4:
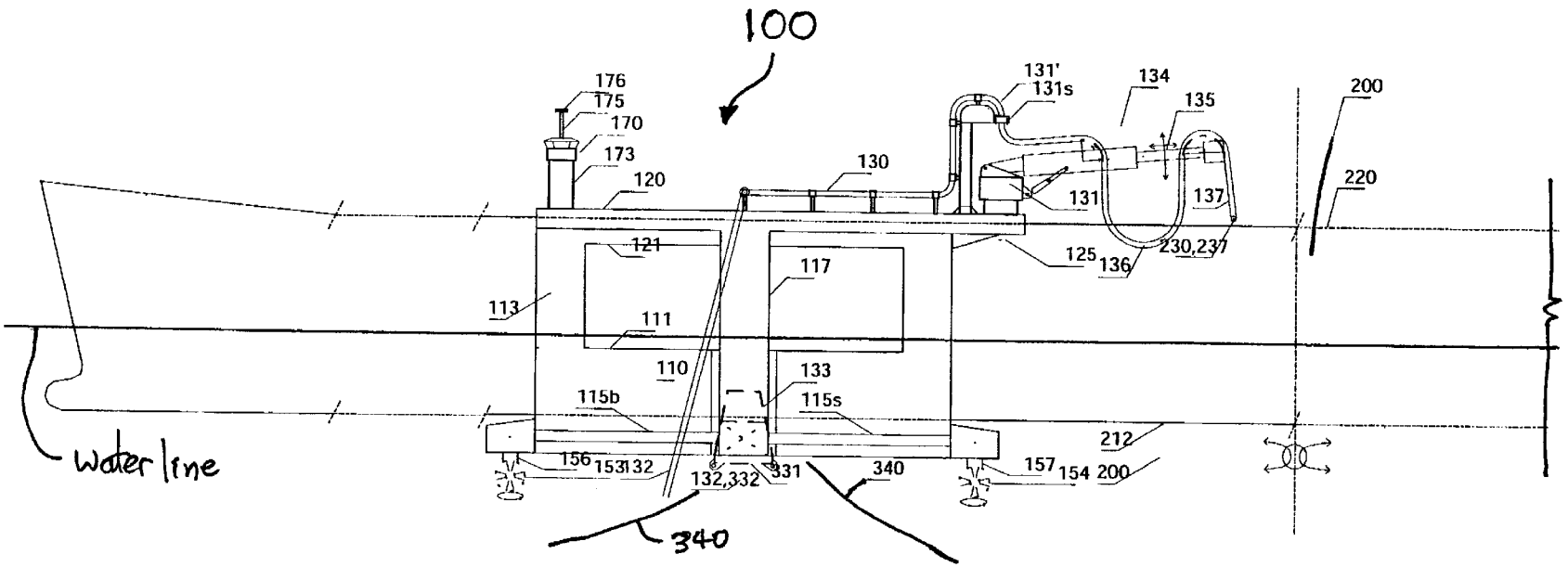

FIG. 3 illustrates in side elevation view the loading device equipped with bow 153 and stern 154 athwartships thrusters respectively, arranged by or under a bow 113 and stem 114 columns respectively. The bow and stem athwartships thrusters 153, 154 are both arranged for directing forces, independently of each other, in the side directions with respect to the loading device 100 and thereby also with respect to the tanker vessel 200 while coupled together. The athwartships thrusters 153 and 154 are preferably arranged to replace the forces from sidewards directed tanker vessel thrusters (250) and tank ship rudder (254), thus capable of giving the tanker vessel (200) the best direction of encounter with current and waves.

The best mode to exert to the upwards directed vertical pressure force towards the tanker vessel bottom with the contact surfaces 118', 119' is to use ballast controlled longship bulkhead pontoons 118 and at least one athwartships bulkhead pontoon 119 which support the contact surfaces 118' and 119' respectively. These longships bulkhead pontoons are arranged in an inner athwartships hull **112*i* arranged to be pushed in under the tanker vessel's 200 bottom surface 212. In the most preferred embodiment of the invention the longship bulkhead pontoon 118 with the contact surface 118' is arranged exactly under and along the lower baseline for one of the tanker vessel's 200 longship bulkhead plates 218. The athwartships bulkhead pontoon 119 shall be arranged exactly under and along the baseline of one of the tanker vessel's 200 athwartships bulkhead plates 219. The chief in command of the operation of the loading device should in due time before the docking of the loading device 100 against the tanker vessel 200 acquire certain information of the exact position of the tanker vessel's athwartships bulkhead plates afore midship. In a practical embodiment this may be conducted by a direct markup of the athwartships bulkhead plate of the tanker vessel 200 to be used, directly on the ship's side or on the deck over the athwartships bulkhead plate. (Alternatively, an ultrasound sonde may be applied on the tanker vessel's 200 hull in order to find a bulkhead plate's baseline or contact with the outer skin). It is also essential to the tanker vessel's mechanical or structural integrity that the contact surface 118' makes a good fit along the baseline of a longship bulkhead plate 218 on the tank ship bottom 212. Thus the chief in operation for the loading device must also acquire certain information about how far in from the ship's side the longship bulkhead 218 is situated. These longship bulkheads 218 may in ordinary tanker vessels 200 be arranged approximately as indicated by broken lines in FIG. 1**, or as a centered longship bulkhead in smaller tanker vessels.

It is possible to make embodiments of the submerged hull's part with contact surfaces having many different outlines, but the preferred embodiment comprises an athwartships hull 112 comprising the inner athwartships hull **112*i* and an oppositely directed outer athwartships hull 112*o*. The length of the inner athwartships hull 112*i* should be at least as long as may be expected to be the half-width of a tanker vessel 200. A corresponding but rather shorter extent should be calculated for the oppositely directed outer athwartships hull 112*o***.

A central hull 111 arranged perpendicularly of the athwartships hull 112 and thus longship with respect to the tanker vessel 200, is designed for being aligned along the tanker vessel's 200 ship side 217 upon docking and during the entire cargo transfer. In the preferred embodiment of the invention, the central hull 111 is essentially higher than the athwartships hull 112, but has its bottom surface in the same level as the athwartships hull 112. Thus the central hull contributes an essential part of the loading device's 100 displacement and buoyancy force in a semisubmerged position. The side surface of the central hull towards the tanker vessel constitutes, together with the bow column 113, the central column 117 and the stem column 114 and the upper longship pontoon, a large vertical plane frame wall constituting a plane contact surface for placement near the ships side 217 on coupling to the tanker vessel. This plane contact surface is essentially perpendicular to the preferably horizontal plane constituted by the contact surfaces 118' and 119'. Separation or thickness adjustable fenders (not illustrated) are arranged to form a desired distance between the central hull 111 and the ships side 217 of the tanker vessel 200. No distance adjustment pieces for the contact surfaces 118' and 119' are necessary because the loading device 100 may be ballasted to the correct submergence depth. Ordinary mooring hawsers (not illustrated) may be arranged between the tanker vessel 200 and the central hull 111 during the cargo transfer operation, but mooring hawsers are in principle not needed.

The extent of the athwartships hull 112 contributes with two essential advantageous properties: the loading device has a large width. This large width contributes to the stability of the loading device, particularly when it is in the transition phase between an upper stable situation of entirely floating on the athwartships hull 112 and the central hull 111, and a semisubmerged stable situation of floating on two pontoons; one upper athwartships pontoon 123 extending from the central column 117 to the outer balancing column 115, and another upper longships pontoon 121 extending over the bow column 113, the central column 117, and the stem column 114. The other advantage is that the inner longship thruster 151 which is arranged on the extreme end (inner end with respect to the tanker vessel 200, ref. FIG. 1) may be placed far in under the tank ship bottom 212. The central hull's large extent, comparable with a tank ship's width, is essential in order to generate a large torsion moment from the two power devices 153 and 154 about a vertical axis through the loading device 100.

The loading device has in the preferred embodiment a bow column 113 arranged in the bow end of the central hull 111, and a stem column 114 arranged in the stem end of the central hull 111. A central column 117 erects over the crossing area of the central hull 111 and the athwartships hull 112. The central column is essential for a load stable preferred embodiment of the load device 100 having the inlet for the flexible hose 132, 332 arranged centrally in the bottom of the central column 117. This will be explained below. An outer balancing column 115 is arranged near the outer end of the outer athwartships hull **112*o*. Using columns between the submerged part 111, 112 and the part above the sea comprising an upper longship deck 120, an upper athwartships deck 112 and the crane boom 134, has two immediate advantages: the small cross-section area of the columns 113, 114, 115, and 117 makes a small change of ballast volume constitute a large change of draught for the athwartships hull 112**. Thus the draught of the loading device may be rapidly adjusted.

Ballasting or deballasting is necessary to bring the contact surfaces 118, 119' to a correct depth, deeper than the draught of the tanker vessel's 100 bottom 212, before the athwartships thrusters 153, 154 push the inner athwartships hull 112*i* with the longship bulkhead pontoon 118 and the athwartships bulkhead pontoon 119 in position under the tank ship's bottom 212. Continuous adjustment of the ballast in the loading device 100 is necessary due to adaptation with respect to the tanker vessel's 100 draught during cargo transfer to the tanker vessel 100 in every intermediate positions between the shallow position with the tanker vessel floating high and ballasted, and with empty cargo tanks, to the deep draught position with full cargo tanks, and usually empty ballast tanks.

In the preferred embodiment with the columns 113, 114, 115, and 117 the loading device is a kind of semisubmersible vessel. When the water crosses only the columns 113, 114, 115, and 117, the loading device will be little affected by surface waves within a wide range of wave periods or frequencies, due to a low ratio between the total waterline area and the total mass, in the same way as for semisubmersible drilling and production platforms. In this position the vessel may however be vulnerable due to reduced stability compared to the situation with the vessel only floating on the central hull 11 and the athwartships hull 112. As a safety precaution with regard to conditions where such stability is essential, we have arranged an upper longships pontoon 121 extending between the upper ends of the bow column 113, the central column 117, and the stem column 114, with the top of the longship pontoon 121 constituting a longship deck 120. An upper athwartships pontoon 123 extends between the central column 117 and the outer balancing column 115 constituting a bridge construction having an athwartships deck 122 as its top surface. The longship deck 120 and the athwartships deck 122 are necessary as work decks and to carry swivels, winches, craned and other deck equipment described below. A square frame comprising outer head (bow) pontoon stay beam 115*b*, outer stern pontoon stay beam 115*s*, inner head pontoon stay beam 116*b*, and inner stem pontoon stay beam 116*s* is arranged in the lower level for two purposes: to stiffen up the ends of the cross constituted by the central hull 111 and the athwartships hull 112, and to constitute buoyancy or ballast tanks respectively. In a preferred embodiment there may also be arranged horizontal stay beams in the deck level between the bow column 113 and the balancing column 115, and also between the balancing column 115 and the stern column 114.

The inner longship thruster 151 may be rotatable between a longship direction and a vertical direction about an inner longship thruster axial sleeve bearing 152 arranged with its axis along an athwartships horizontal axis.

The bow athwartships thruster 153 and the stern athwartships thruster 154 are in a preferred embodiment rotatable about a head athwartships thruster rotation sleeve bearing 156 and a stern athwartships thruster axial rotation sleeve bearing 157. This makes rotation possible to a position where they in ensemble may contribute to a force assisting the longship thruster 151 with a force directed in the longship direction of the tanker vessel 200.

In a preferred embodiment the crane boom 134 is arranged rotatable in the vertical plane on a rotating tower 131 near the stern column 114, preferably on a crane tailwing 125, having a vertical rotation tower axis 131 'arranged axially with the axis in a vertical axis swivel 131*s* and with a telescope boom 135, a flexible hose part or a telescope pipe 136 arranged to follow the changes of length of the telescope boom 135, and a loading hose bulkhead 137 arranged to be connected to a manifold connector 237 of a midship manifold 230 of the tanker vessel 200. The crane boom 134 should be swung out from the ship's side 217 before coupling together of the loading device 100 and the tanker vessel 200 in order to avoid collision. In the same way, the crane boom 134 should be swung out from the ship's side 217 before disconnecting the loading device, due to the same reason.

In a most preferred embodiment of the invention, the flexible hose 132, 332 connecting the loading device with the upstream petroleum source 300 is led through the bottom of the central column 117 and fluid connected with the loading hose 130.

In a somewhat less stable alternative embodiment the flexible hose 132 which connects the loading device with the upstream petroleum source 300 is led via a swivel 139 on a wing on the upper athwart hull deck 122 by the outer balancing column 115.

In an alternatively preferred embodiment of the invention the loading device 100 constitutes an adapter for use of an STL-buoy 331 to conventional tanker vessel 200, where an STL-dock 133 is arranged in the bottom of the loading device 100 in the lower end of the central column 117. This dock is in this embodiment indicated by the widening in the lower part of the central column 117 which may be seen in all of FIGS. 1, 2, and 3. The STL-dock 133 is as in the known art arranged to receive and connect to a fluid channel 338 on the STL-buoy 331, and having an anchoring swivel (not illustrated) arranged to pivotally receive the mooring forces from the STL-buoy's 331 anchor lines 340, so that the STL-buoy 331 and its flexible hose 332 constitutes the flexible hose 132. A winch 138 is arranged to draw or guide the STL-buoy 331 into the STL-dock 133. To facilitate coupling between the tanker vessel 200 and the loading device 100, the loading device may release the STL-buoy 331 from the STL-dock 133, and thereafter pick up the tanker vessel 200 and bring this to the correct position by means of the DP devices for docking of the STL-buoy in the STL-dock 133. In addition the tanker vessel 200 is rotated to a favorable direction with respect to wind, waves and current.

A preferred embodiment of the invention comprises a pilothouse 170 on a pilothouse tower 173, preferably having a control or operation 171 arranged for dynamic positioning of the vessels, control and surveillance of the docking or coupling and cargo transfer operation between the loading device 100 and the tanker vessel (200), with a radar 176 in a radar mast 175. The pilothouse 170 and/or the operation room should be arranged with an elevation high enough that the pilot of the loading device 100 should be allowed to see above the tanker vessel's 200 bulwark 273 in the bow part 213. There may also be arranged sensors 177 for measuring distances between the loading device 100 and the tanker vessel 200 in order to better guide the coupling together and disconnection operations.

End Notes

Such an embodiment as described above may naturally also be applied for offloading tanker vessels in areas where this is found practical. Suction devices, magnets and other attachment devices may be imagined to replace or supplement the friction contact surfaces 118, 119 contact force which here has been described by means of deballasting. In the same manner one may imagine a square-shaped underwater part (the pontoon stay beams may e.g. be made with a larger square section) instead of the cross shape constituted by the central hull 111 and the athwartships hull 112. The invention is described in a non-limiting example, and people skilled in the art would be able to describe obvious improvements of the invention without necessarily being outside the scope of the invention, and which should be defined by the attached patent claims.

What is claimed is:

1. A loading device for marine transfer of fluids via a flexible hose from a petroleum production platform to an ordinary tanker vessel, the tanker vessel including a hull having a bottom surface and longship bulkheads and athwartship bulkheads, the loading device comprising:

a main hull including a submerged hull and a structure rising above the waterline and resting on the submerged hull, the submerged hull including an inner athwartships hull arranged for being pushed in under the bottom surface of the tanker vessel hull, and including upwards directed contact surfaces, the submerged hull being arranged for being ballasted and deballasted for docking towards the bottom surface of the tanker vessel hull using direct contact friction;

a loading hose arranged in a crane boom supported by the main hull, the loading hose being connected upstream to the flexible hose and arranged for transferring fluid to the tanker vessel;

power devices arranged for moving the loading device into and out of a catching position with the tanker vessel, and arranged to control the tanker vessel's position during the operation of fluid transfer; and ballast controlled pontoons supporting the submerged hull, wherein the ballast controlled pontoons include:

a longship bulkhead pontoon arranged for being placed under and along a baseline of one of the tanker vessel's longship bulkheads, and an athwartship bulkhead pontoon arranged for being placed under and along a baseline of one of the tanker vessel's athwartships bulkheads.

2. A loading device for marine transfer of fluids via a flexible hose from a petroleum production platform to an ordinary tanker vessel, the tanker vessel including a hull having a bottom surface and longship bulkheads and athwartship bulkheads, the loading device comprising:

a main hull including a submerged hull and a structure rising above the waterline and resting on the submerged hull, the submerged hull comprising an athwartship hull comprising the inner athwartships hull arranged for being pushed in under the bottom surface of the tanker vessel hull, and an oppositely directed outer athwartships hull, and including upwards directed contact surfaces, the submerged hull being arranged for being ballasted and deballasted for docking towards the bottom surface of the tanker vessel hull using direct contact friction;

a loading hose arranged in a crane boom supported by the main hull, the loading hose being connected upstream to the flexible hose and arranged for transferring fluid to the tanker vessel;

power devices arranged for moving the loading device into and out of a catching position with the tanker vessel, and arranged to control the tanker vessel's position during the operation of fluid transfer;

ballast controlled pontoons supporting the submerged hull, wherein the ballast controlled pontoons include:

a longship bulkhead pontoon arranged for being placed under and along a baseline of one of the tanker vessel's longship bulkheads, and an athwartship bulkhead pontoon arranged for being placed under and along a baseline of one of the tanker vessel's athwartships bulkheads; and a central hull arranged perpendicularly relative to the athwartships hull, the central hull arranged for being placed along the side of the tanker vessel.

3. A loading device for marine transfer of fluids via a flexible hose from a petroleum production platform to an ordinary tanker vessel, the tanker vessel including a hull having a bottom surface and longship bulkheads and athwartship bulkheads, the loading device comprising:

a main hull including a submerged hull and a structure rising above the waterline and resting on the submerged hull, the submerged hull comprising an athwartship hull comprising the inner athwartships hull arranged for being pushed in under the bottom surface of the tanker vessel hull, and an oppositely directed outer athwartships hull, and including upwards directed contact surfaces, the submerged hull being arranged for being ballasted and deballasted for docking towards the bottom surface of the tanker vessel hull using direct contact friction;

a loading hose arranged in a crane boom supported by the main hull, the loading hose being connected upstream to the flexible hose and arranged for transferring fluid to the tanker vessel;

power devices arranged for moving the loading device into and out of a catching position with the tanker vessel, and arranged to control the tanker vessel's position during the operation of fluid transfer;

ballast controlled pontoons supporting the submerged hull, wherein the ballast controlled pontoons include:

a longship bulkhead pontoon arranged for being placed under and along a baseline of one of the tanker vessel's longship bulkheads, and an athwartship bulkhead pontoon arranged for being placed under and along a baseline of one of the tanker vessel's athwartships bulkheads;

a central hull arranged perpendicularly relative to the athwartships hull, the central hull arranged for being placed along the side of the tanker vessel;

a bow column arranged near the bow end of the central hull;

a stem column arranged near the stem end of the central hull;

an outer balancing column arranged near the outer end of the outer athwartships hull; and a central column erected over the crossing area of the central hull and the athwartship hull.

4. The loading device of claim 3, wherein the crane boom is rotatable in the vertical plane and arranged on a rotating tower near the stern column, on a tail crane wing, the rotating tower having a vertical rotation axis axially arranged with the axis of a vertical axial swivel and further including a loading hose bulkhead arranged for being connected to a manifold connector of a midship manifold on the tanker vessel.

5. The loading device of claim 4, wherein the crane boom is telescopic and further including a flexible hose part arranged for following changes in length of the telescopic crane boom.

6. The loading device of claim 4, wherein the crane boom is telescopic and further including a telescopic pipe arranged for following changes in length of the telescopic crane boom.

7. A loading device for marine transfer of fluids via a flexible hose from a petroleum production platform to an ordinary tanker vessel, the tanker vessel including a hull having a bottom surface and longship bulkheads and athwartship bulkheads, the loading device comprising:

a main hull including a submerged hull and a structure rising above the waterline and resting on the submerged hull, the submerged hull comprising an athwartship hull comprising the inner athwartships hull arranged for being pushed in under the bottom surface of the tanker vessel hull, and an oppositely directed outer athwartships hull, and including upwards directed contact surfaces, the submerged hull being arranged for being ballasted and deballasted for docking towards the bottom surface of the tanker vessel hull using direct contact friction;

a loading hose arranged in a crane boom supported by the main hull, the loading hose being connected upstream to the flexible hose and arranged for transferring fluid to the tanker vessel;

power devices arranged for moving the loading device into and out of a catching position with the tanker vessel, and arranged to control the tanker vessel's position during the operation of fluid transfer;

ballast controlled pontoons supporting the submerged hull, wherein the ballast controlled pontoons include:

a longship bulkhead pontoon arranged for being placed under and along a baseline of one of the tanker vessel's longship bulkheads, and an athwartship bulkhead pontoon arranged for being placed under and along a baseline of one of the tanker vessel's athwartships bulkheads;

a central hull arranged perpendicularly relative to the athwartships hull, the central hull arranged for being placed along the side of the tanker vessel;

a bow column arranged near the bow end of the central hull;

a stem column arranged near the stem end of the central hull;

an outer balancing column arranged near the outer end of the outer athwartships hull;

a central column erected over the crossing area of the central hull and the athwartship hull;

an upper longship pontoon extending between the upper ends of the bow column, the central column and the stern column, the upper longship pontoon having an upper longship deck thereon; and an upper athwartship pontoon extending between the central column and the outer balancing column, the upper athwartship pontoon having an upper athwartship deck thereon.

8. The loading device of claim 7, in which the flexible hose connecting the loading device with the petroleum production platform is guided via a swivel on a tail wing on the upper athwartships deck near the outer balancing column.

9. A loading device for marine transfer of fluids via a flexible hose from a petroleum production platform to an ordinary tanker vessel, the tanker vessel including a hull having a bottom surface, the loading devices comprising:

a main hull including a submerged hull and a structure rising above the waterline and resting on the submerged hull, the submerged hull including upwards directed contact surfaces and arranged for being ballasted and deballasted for docking towards the bottom surface of the tanker vessel hull using direct contact friction;

a loading hose arranged in a crane boom supported by the main hull, the loading hose being connected upstream to the flexible hose and arranged for transferring fluid to the tanker vessel; and power devices arranged for moving the loading device into and out of a catching position with the tanker vessel, and arranged to control the tanker vessel's position during the operation of fluid transfer; and wherein the loading device includes, a bow column and a stem column thereon, and wherein the power devices comprise:

an inner longship thruster arranged: for exerting force in the long direction of the tanker vessel; and head and athwarthships thrusters arranged near the bow column and the stem column respectively, and arranged for directing forces in the sideways direction relative to the loading device and the tanker vessel.

10. The loading device of claim 9, wherein the inner longship thruster is rotatable between a longship direction and a vertical direction about an inner longship thruster axial sleeve bearing arranged with its axis along an athwartships horizontal axis.

11. The loading device of claim 9, wherein the head athwartships thruster and the stem athwartships thruster are rotatable about a head athwartships thruster axial sleeve bearing and a stem athwartships thruster axial sleeve bearing, respectively.

12. A loading device for marine transfer of fluids via a flexible hose from a petroleum production platform to an ordinary tanker vessel, the tanker vessel including a hull having a bottom surface, the loading devices comprising:

a main hull including a submerged hull and a structure rising above the waterline and resting on the submerged hull, the submerged hull including upwards directed contact surfaces and arranged for being ballasted and deballasted for docking towards the bottom surface of the tanker vessel hull using direct contact friction;

a loading hose arranged in a crane boom supported by the main hull, the loading hose being connected upstream to the flexible hose and arranged for transferring fluid to the tanker vessel; and power devices arranged for moving the loading device into and out of a catching position with the tanker vessel, and arranged to control the tanker vessel's position during the operation of fluid transfer; and wherein the loading device is for connection with an STL-buoy having a fluid channel and anchor lines, the loading device further including:

an STL-dock disposed in the bottom of the loading device for receiving and connecting to the fluid channel of the STL-buoy; and an anchoring swivel arranged for receiving anchoring forces from the anchor lines of the STL-buoy.

13. A loading device for marine transfer of fluids via a flexible hose from a petroleum production platform to an ordinary tanker vessel, the tanker vessel including a hull having a bottom surface, the loading devices comprising:

a main hull including a submerged hull and a structure rising above the waterline and resting on the submerged hull, the submerged hull including upwards directed contact surfaces and arranged for being ballasted and deballasted for docking towards the bottom surface of the tanker vessel hull using direct contact friction;

a loading hose arranged in a crane boom supported by the main hull, the loading hose being connected upstream to the flexible hose and arranged for transferring fluid to the tanker vessel; and power devices arranged for moving the loading device into and out of a catching position with the tanker vessel, and arranged to control the tanker vessel's position during the operation of fluid transfer; and further including an electrical cable associated with the flexible hose from the petroleum production platform for supplying power to the loading device.

* * * * *